US009445171B2

(12) United States Patent
Hanson-Abbott et al.

(10) Patent No.: US 9,445,171 B2
(45) Date of Patent: Sep. 13, 2016

(54) SOUNDER FOR MOBILE APPARATUS

(75) Inventors: Christopher Hanson-Abbott, London (GB); Hubert Geoffrey Leventhall, Ashtead (GB); Kelly Sands, Darenth (GB)

(73) Assignee: Brigade Electronics (UK) LImited, South Darenth, Kent (GB)

( * ) Notice: Subject to any disclaimer, the term of this patent is extended or adjusted under 35 U.S.C. 154(b) by 421 days.

(21) Appl. No.: 13/819,216

(22) PCT Filed: Aug. 26, 2010

(86) PCT No.: PCT/GB2010/001617

§ 371 (c)(1),
(2), (4) Date: Feb. 26, 2013

(87) PCT Pub. No.: WO2012/025702

PCT Pub. Date: Mar. 1, 2012

(65) Prior Publication Data

US 2013/0156244 A1 Jun. 20, 2013

(51) Int. Cl.

| | |
|---|---|
| ***H04R 1/02*** | (2006.01) |
| ***G08B 21/02*** | (2006.01) |
| ***G08B 3/10*** | (2006.01) |
| *G08B 21/00* | (2006.01) |

(52) U.S. Cl.

CPC ..... *H04R 1/021* (2013.01); *G08B 3/10* (2013.01); *G08B 21/02* (2013.01); *G08B 21/00* (2013.01)

(58) Field of Classification Search

CPC ..... H04R 1/021; H04R 1/30; G10K 1/00; G10K 5/02; G10K 7/02; G10K 7/06; G10K 9/10; G10K 9/12; G08B 21/02; G08B 21/00; G08B 3/10

USPC ..... 381/334; 340/384.4, 384.7, 425.5, 340/815.72

See application file for complete search history.

(56) References Cited

U.S. PATENT DOCUMENTS

| | | | | |
|---|---|---|---|---|
| 2,980,888 A * | 4/1961 | Hothem | G08B 3/10 340/328 |
| 2,989,621 A | 6/1961 | Barton et al. | |
| 3,483,634 A | 12/1969 | Staples et al. | |
| 4,727,331 A * | 2/1988 | Hegeler | B06B 1/0276 327/175 |
| 4,759,067 A * | 7/1988 | Page | G09B 9/56 434/10 |
| 5,012,221 A * | 4/1991 | Neuhaus | G08B 3/10 340/329 |
| 5,949,328 A * | 9/1999 | Latty | G08B 21/24 340/309.16 |

(Continued)

FOREIGN PATENT DOCUMENTS

| | | | |
|---|---|---|---|
| CN | 100520842 C | 7/2009 | |
| JP | 04355391 A * | 12/1992 | G01S 7/52 |

(Continued)

OTHER PUBLICATIONS

System Sensor.RTM., "ExitPoint Directional Sounder with Voice Messaging" Application Guide, Copyrgt 2007, 26 Pages.*

(Continued)

*Primary Examiner* — Davetta W Goins
*Assistant Examiner* — Oyesola C Ojo
(74) *Attorney, Agent, or Firm* — Briggs and Morgan, P.A.; Audrey J. Babcock

(57) ABSTRACT

A sounder for use in mobile apparatus comprising an electronic signal generator and a electroacoustic transducer to generate an audible sound, wherein the sound comprises continuous repetitions of a pre-determined section of substantially broadband sound.

14 Claims, 3 Drawing Sheets

(56) References Cited

U.S. PATENT DOCUMENTS

| | | | | |
|---|---|---|---|---|
| 6,201,470 | B1 * | 3/2001 | Withington | G08B 3/10 340/309.8 |
| 6,885,295 | B2 * | 4/2005 | Hanson-Abbott | B60Q 5/00 340/384.72 |
| 8,018,328 | B2 * | 9/2011 | Goldstein | B60Q 5/00 340/384.1 |
| RE44,912 | E | 5/2014 | Hanson-Abbott et al. | |
| 2003/0118195 | A1 * | 6/2003 | Hama | B06B 1/0618 381/71.1 |
| 2007/0179680 | A1 | 8/2007 | Tamura | |

FOREIGN PATENT DOCUMENTS

| | | | |
|---|---|---|---|
| JP | 07244787 | | 9/1995 |
| JP | 11509022 | | 8/1999 |
| JP | 2001282263 | | 10/2001 |
| JP | 2001282263 | A | 10/2001 |
| JP | 2005238962 | | 9/2005 |
| JP | 2007203924 | | 8/2007 |
| JP | 2007203924 | A | 8/2007 |
| KR | 20070006014 | A | 1/2007 |
| TW | 200816102 | A | 4/2008 |
| WO | 97/03424 | | 1/1997 |
| WO | WO 2005010838 | A1 * | 2/2005 ..... B61L 15/0081 |

OTHER PUBLICATIONS

International Search Report and Written Opinion of PCT/GB2010/001617.

Japanese Office Action for Japanese Application No. 2013-525343 mailed Mar. 24, 2015.

Office Action for Taiwanese Patent Application No. 100130138 (national phase application of PCT/GB2010/001617); Jul. 20, 2015.

* cited by examiner

SOUNDER FOR MOBILE APPARATUS

The present invention relates to a sounder for use with mobile apparatus.

In the past, electrically-powered vehicles or mobile apparatus have been limited by the capacity of the electrical storage and the speed and maneuverability possible under electrical locomotion. Electric vehicles were selected for use in situations where their quietness was more important than the limitations placed upon them by the technological restraints. Examples of well-known electrical vehicles are milk floats. Milk floats are traditionally electrically-powered so their movement in the streets in the early hours does not disrupt the peace and tranquillity of those streets.

However as technology has progressed in the field of electrical locomotion and the desire for low-emissions vehicles increased, the number of applications for electrical mobile apparatus has broadened significantly.

In recent years the hybrid vehicle has become popular. Hybrid vehicles run on batteries when running at low speed in urban environments and on hydrocarbon fuel when higher performance is required. At the present time many vehicle manufacturers are investing in producing electric-only vehicles.

Whereas electric milk floats and the like are advantageous because of their quietness, under more common circumstances the quietness of electric vehicles could be significantly disadvantageous. Pedestrians in particular have become used to using the sound of an approaching vehicle to judge its direction and distance in order to prevent being run over. Pedestrians who are not accustomed to the quietness of electric vehicles are more likely to be involved in a collision with one. People with limited sight will rely more heavily than average on the sound of an approaching vehicle. It has been shown that electric and hybrid vehicles are much more likely to be involved in road accidents than traditional internal combustion-powered vehicles.

Therefore it is desirable for a quiet vehicle to generate a sound which can be understood by pedestrians to come from a moving vehicle in order that the pedestrians can make informed decisions, for example as to whether or not to step into a road.

It is an aim of the present invention to provide a sounder for mobile apparatus including electric and hybrid vehicles which can give information to pedestrians and other people in the vicinity of the mobile apparatus in order to improve the safety of the mobile apparatus.

Accordingly the present invention is directed to a sounder for use in mobile apparatus comprising an electronic signal generator and a electroacoustic transducer to generate an audible sound, wherein the sound comprises or consists of continuous repetitions of a pre-determined section of substantially broadband sound.

The invention uses broadband sound to act as a warning and locating device, whilst at the same time possessing the cyclical properties which are indicative of the familiar sound of the approach of a vehicle powered by an internal combustion engine.

Broadband sound comprises a wide spread of frequencies within the range of audible frequencies. If the level of the sound is constant with frequency the sound is known as white sound. Level in this sense means noise level. If the level of the sound falls at specified rates, the sound is described in other ways. For example, a sound which has a fall off of 3 dB in level as the frequency doubles, is known as a pink sound. The general term of broadband is given when a sound comprises a wide range of audible frequencies. Additionally, the sound can be manipulated to enhance parts of its frequency spectrum as may be desired for a particular application. The method of the invention may be applied to any type of sound: broadband, narrow band or another type.

Broadband sound has advantageous properties over tonal sound and other configurations of multiple-frequency sound in that it can be more readily detected by the human ear in such a way as to give an indication of the direction of the source of the sound. Broadband sound is also less intrusive and less annoying to the human ear than a single tone or small range of tones. Therefore a sound solely of broadband sound has considerable noise pollution advantages.

In a preferred embodiment the broadband sound consists of white noise or pink noise.

A sound envelope is a discrete reproducible unit of sound with a defined frequency/intensity/time relationship. A particular sound envelope can be generated on demand by electronic components or recorded digitally for use when required.

Preferably the section of broadband sound may consist of substantially broadband sound with at least one audible variation in intensity.

Advantageously the audible variation in intensity may be small in relation to the average intensity of the section of broadband sound.

In a preferred embodiment the section of broadband sound may consist of substantially broadband sound and at least one variation in the intensity of a pre-determined set of frequencies within the broadband sound range of frequencies.

Preferably the intensity of the variation may be small in relation to the average intensity of the section of broadband sound.

Advantageously the intensity of the variation may be less than 10% of the average intensity of the section of broadband sound.

In a preferred embodiment the frequency of the repetitions may be varied. Advantageously the length of the sound envelope can be varied. This provides the advantage that the sound produced sounds more like that of a car engine.

Preferably the frequency or loudness of the repetitions may be configured in such a way as to give information about the speed of the vehicle. Pedestrians used to the different sounds made by traditional internal combustion engines will respond differently to an engine depending on how they perceive its speed. Generally the repetitions and/or loudness will increase in frequency with the speed of the vehicle.

Advantageously the content of the pre-determined sound clip may be varied.

In a preferred embodiment the average intensity of the sound may be varied.

In different situations it would be desirable for the sound to be generated at differing intensities or loudnesses. When a mobile apparatus is travelling at a very low speed the movement of a vehicle itself generates very little noise. However at a higher speed a vehicle may generate a much louder noise. It would be advantageous, therefore, to vary the intensity of the section of broadband sound to take account of the different situations.

Above a certain speed a hybrid or electric vehicle will generate a similar amount of noise as a car powered by an internal combustion engine. At speeds greater than this certain speed there would be no added value in artificially generating a sound and therefore it could be desirable for the sounder to be switched off.

Sounders according to the present invention will, now be described in relation to the accompany drawings in which.

The section of broadband sound for this application can either be produced by a generation device contained in the device or may be stored electronically and reproduced by a appropriate playing means.

Figure 1:
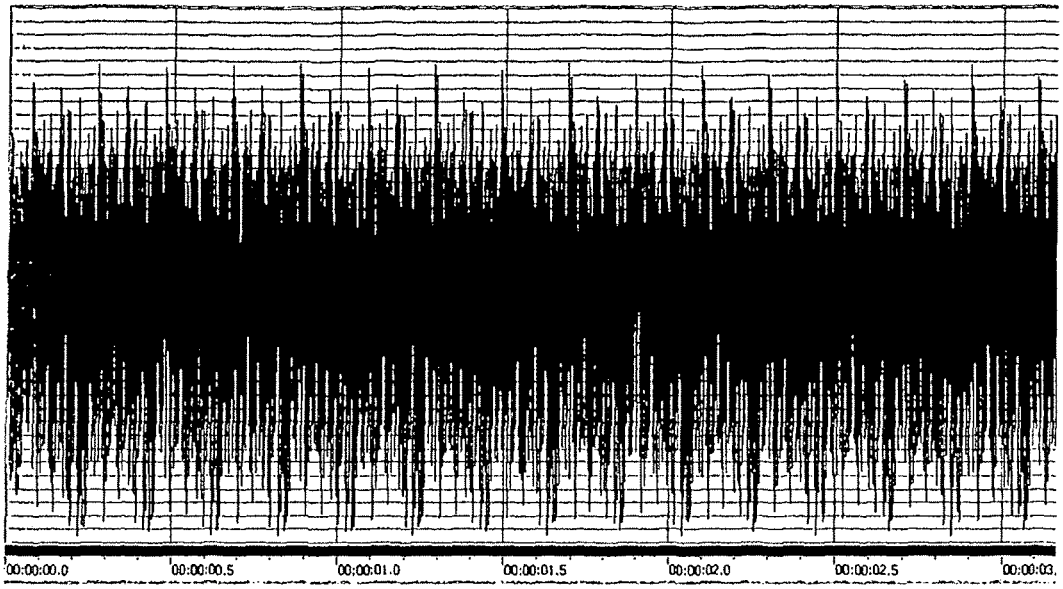
FIG. 1 shows a 3-second example of a continuous waveform of a sound developed according to the invention and based on a pink noise.

FIG. 1 shows a 3-second example of a continuous waveform of a sound developed according to the invention and based on a pink noise. The repetitive nature is visible. Close inspection of the waveform shown in FIG. 1 reveals that it possesses a repetitive characteristic, shown clearly by the positive peaks of the waveform. As the time scale above the waveform is in seconds, there are 15 of these peaks between 0 sec and 3 sec, which is a repetition rate of five a second. Consequently, in addition to the inherent broadband spectrum, which is a well known characteristic of pink noise, the sound produced according to the principles of the invention also possesses an added pulsation, which is such as to warn the listener of a nearby vehicle. The new sound thus has two main characteristics.

1. The desirable properties of broadband sound used as a locating sound
2. The desirable property of indicating the presence of a vehicle, so that any necessary action can be taken Although the illustration has been for a repetition rate of five a second, the invention is not limited to this and a multiplicity of repetition rates may be employed, depending on the circumstances of the application of the invention.

Figure 2:
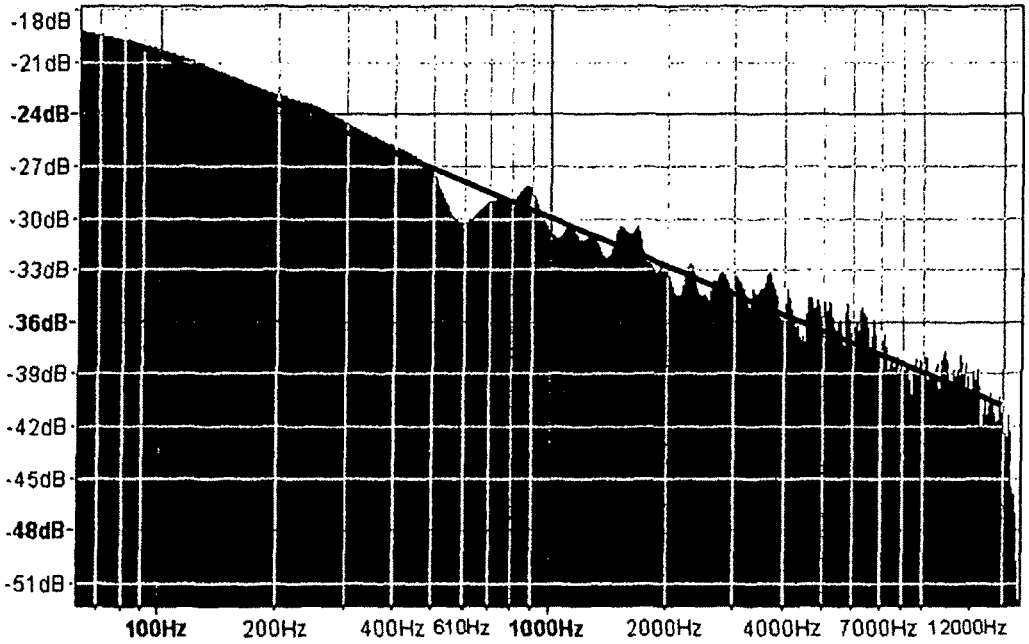
FIG. 2 shows the frequency analysis of the waveform in FIG. 1.

FIG. 2 shows the frequency analysis of the waveform in FIG. 1. An ideal pink noise has a spectrum which falls linearly at 3 dB for each doubling of frequency. The repetition of a short section of pink noise, as used in the invention, adds some irregularity to the linear falling spectrum, as shown in FIG. 2, but the characteristic spectrum of the pink noise, as shown in the straight line which has been added to the spectrum, is closely followed. Note that, in FIG. 2, the vertical decibel scale is relative level with divisions of 3 dB.

The sound which is actually radiated from the vehicle will consist of that shown in FIG. 1, but modified by the electronic systems employed and by the radiation properties of the loudspeaker used for generation of the audible signal. As a small loudspeaker is likely to be used, because of space restrictions on a vehicle, there will be deficiencies in radiation of the lowest frequencies, but this is of no consequence, as it is the higher frequencies which are relevant for localisation of the source of sound. Additionally, the invention produces a pulsating engine-like effect without the need for reproducing the low frequencies which are inherent in the rotation of an internal combustion engine that is operating at slow speed, such as in a slowly moving vehicle.

Figure 3:
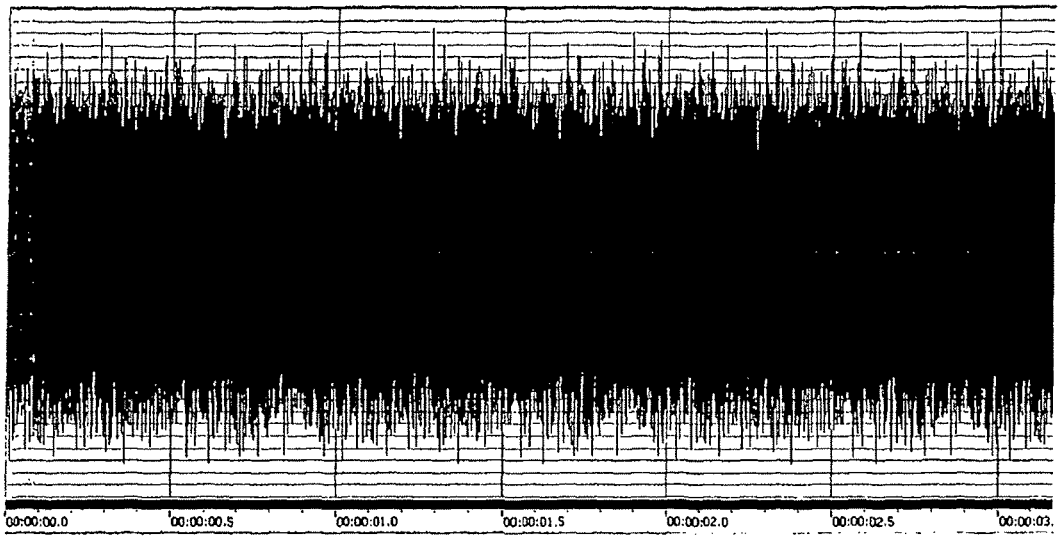
FIG. 3 shows the continuous waveform of a sound based on a white noise according to the invention.

FIG. 3 shows the continuous waveform of a sound developed according to the invention and based on a white noise. The description given above for the sound in FIG. 1 also applies to this waveform, except that it is more difficult to observe the repetitions in this figure. This is due to the additional higher frequencies which occur in a white sound, in which the level of the spectrum is constant with frequency.

Figure 4:
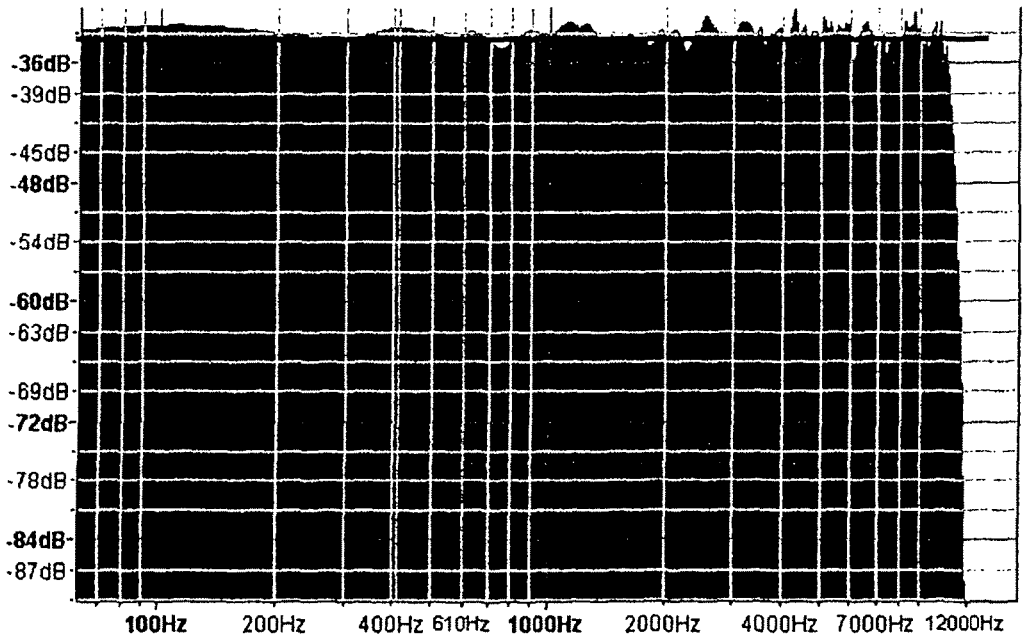
FIG. 4 shows the frequency analysis of the waveform in FIG. 3.

FIG. 4 shows the frequency analysis of the waveform in FIG. 3. It is seen to be essentially level with frequency as in an unmodified white noise. Comparison of the spectrum irregularities with the horizontal line which has been added to the spectrum, shows that the spectrum of the pulsating sound deviates from the spectrum of an ideal white sound by less than 3 dB.

Figure 5:
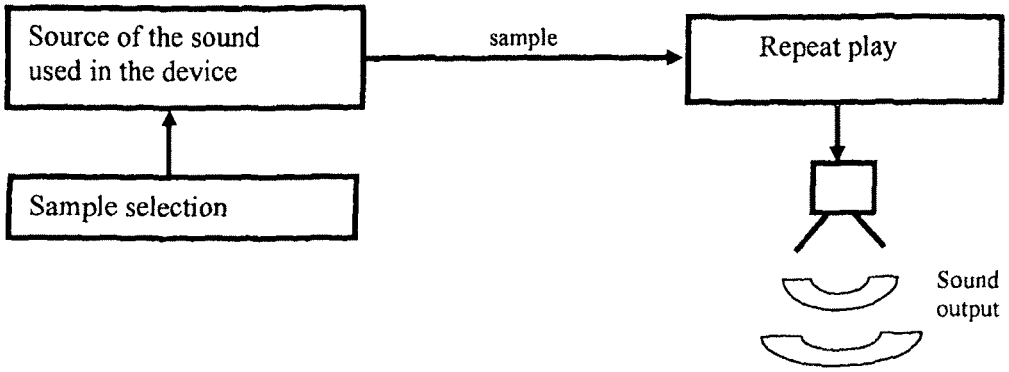
FIG. 5 shows a block diagram illustrating the production of sound according to the invention.

FIG. 5 shows a block diagram of the process involved in the creation of a pulsating broadband sound according to the present invention. A sound sample of the required length is selected either from a signal generator or a recording. This is then used as the source of the pulsating broadband sound produced by the device. This sample is then repeated continuously in a predetermined fashion and the sound outputted from a loudspeaker. The audible quality of the sound can be varied by imposing small fluctuations on the lengths of successive repetitions.

The operation of the invention can be understood by reference to FIG. 5, which shows one embodiment of the invention. A short sample of sound to be used is first selected from a longer sound and loaded into a device in which it is repeated continuously. This device could be a digital editor, such as is commonly used for waveform manipulation on computers. The device is used to produce, for example, a 10 second sample of the pulsating waveform, which will contain 50 repetitions at five a second, 40 repetitions at four a second etc. The sample can be loaded into a memory microchip as the source of the pulsating warning sound. The microchip is then accessed when the vehicle is in motion and the stored sound played continuously during the time in which the vehicle is moving slowly, and thus presenting a hazard to others due to the vehicle's own low level of inherent noise.

Figure 6:
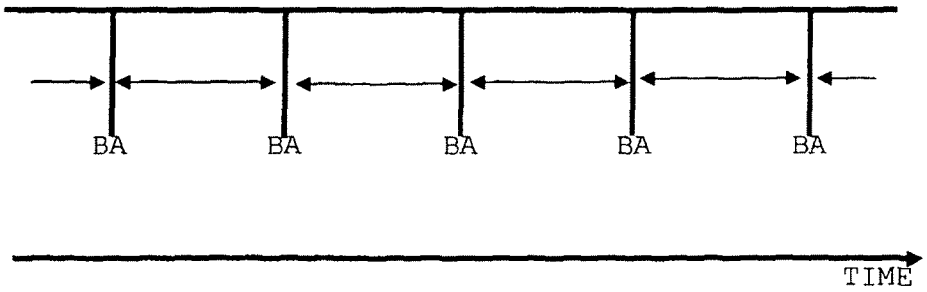
FIG. 6 shows a sequence for the production of the repeating pulses.

FIG. 6 illustrates the repetitive sound where A represents the start of the sample of the sound and B represents the end of the sample of the sound. It is seen that A follows B with no interval or interruption, continuing in this way throughout the operation of the sounder. The sound is continuous, but with the properties of both broad band and audible pulsation.

The invention claimed is:

1. A sounder for use in mobile apparatus comprising an electronic signal generator and a electroacoustic transducer to generate an audible sound, wherein the sound comprises continuous repetitions of a pre-determined section of substantially broadband sound with at least one audible variation in intensity, wherein the audible variation in intensity is less than 10% of the average intensity of the section of broadband sound.

2. The sounder according to claim 1 wherein the broadband sound consists of white noise or pink noise.

3. The sounder according to claim 1, wherein the section of broadband sound consists of substantially broadband sound.

4. A sounder for use in mobile apparatus comprising an electronic signal generator and a electroacoustic transducer to generate an audible sound, wherein the sound consists of continuous repetitions of a pre-determined section of broadband sound wherein the section of broadband sound consists of substantially broadband sound and at least one variation in the intensity of a pre-determined set of frequencies within the broadband sound range of frequencies, and wherein the intensity of the variation is less than 10% of the average intensity of the section of broadband sound.

5. The sounder according to claim 1 wherein the frequency of the repetitions can be varied.

6. The sounder according to claim 1 wherein the content of the section of pre-determined broadband sound can be varied.

7. The sounder according to claim 1 wherein the average intensity of the sound can be varied.

8. The sounder according to claim 1 wherein the section of broadband sound is stored electronically.

9. The sounder according to claim 1 wherein the length of each section of sound is varied.

10. The sounder according to claim 4 wherein the frequency of the repetitions can be varied.

11. The sounder according to claim 4 wherein the content of the section of pre-determined broadband sound can be varied.

12. The sounder according to claim 4 wherein the average intensity of the sound can be varied.

13. The sounder according to claim 4 wherein the section of broadband sound is stored electronically.

14. The sounder according to claim 4 wherein the length of each section of sound is varied.

* * * * *